United States Patent [19]

Udell

[11] Patent Number: 5,065,883

[45] Date of Patent: Nov. 19, 1991

[54] TAMPER EVIDENT CLOSURE

[75] Inventor: Theodore H. Udell, West Chester, Pa.

[73] Assignee: Container Corporation of America, Clayton, Mo.

[21] Appl. No.: 583,474

[22] Filed: Sep. 17, 1990

[51] Int. Cl.[5] ..... B65D 51/20

[52] U.S. Cl. ..... 220/276; 220/257; 220/284; 215/251

[58] Field of Search ..... 215/251, 356, 258, 250, 215/249, 252; 220/257, 265, 266, 276, 268, 284, 285, 288

[56] References Cited

U.S. PATENT DOCUMENTS

| | | | |
|---|---|---|---|
| 1,029,738 | 6/1912 | Baruch | 215/251 |
| 1,193,158 | 8/1916 | Laguionie | 215/250 |
| 1,482,823 | 2/1924 | Stattmann | 215/251 |
| 1,656,229 | 1/1928 | Parish | 220/284 X |
| 1,799,244 | 4/1931 | Parish | 220/284 X |
| 1,891,033 | 12/1932 | Wackman | 220/284 |
| 1,901,196 | 3/1933 | Shera | 220/304 X |
| 1,982,144 | 11/1934 | Shera | 220/257 |
| 1,997,203 | 4/1935 | Shera | 220/257 |
| 2,137,999 | 11/1938 | Curtis | 220/257 |
| 2,195,379 | 3/1940 | Kempe | 215/354 X |
| 2,387,990 | 10/1945 | Grosser | 220/284 |
| 2,801,022 | 7/1957 | Evenblij | 220/284 |
| 3,999,677 | 12/1976 | Oberkircher | 220/266 |
| 4,014,459 | 3/1977 | Robinson | 220/380 |
| 4,407,422 | 10/1983 | Wilde et al. | 215/246 |
| 4,573,598 | 3/1986 | Perry | 215/204 |
| 4,607,759 | 8/1986 | Boetzkes | 220/266 |
| 4,706,836 | 11/1987 | Greck | 220/256 |
| 4,709,823 | 12/1987 | Beck et al. | 215/235 |
| 4,718,571 | 1/1988 | Bordner | 220/270 |
| 4,733,787 | 3/1988 | Knopf et al. | 215/251 |
| 5,004,110 | 4/1991 | Osip et al. | 215/232 |
| 5,021,351 | 6/1991 | Ervin | 435/297 |

FOREIGN PATENT DOCUMENTS

| | | | |
|---|---|---|---|
| 40976 | 2/1910 | Fed. Rep. of Germany | 215/251 |

*Primary Examiner*—Stephen Marcus
*Assistant Examiner*—Stephen Cronin
*Attorney, Agent, or Firm*—Richard W. Carpenter

[57] ABSTRACT

A tamper evident, unitary, plastic overcap adapted to be placed over a container neck flange, which neck flange has, adjacent its outboard end, a radially outwardly protruding annular ridge. The overcap comprises a relatively thin, flat, round, end wall having extending axially inboard therefrom an a cylindrical skirt with a plurality of circumferentally spaced, integral projections extending radially inward from an inboard portion of said skirt and adapted to underlie a container neck flange ridge, so that said overcap cannot be removed from a container neck flange without at least partial destruction of said overcap.

2 Claims, 1 Drawing Sheet

TAMPER EVIDENT CLOSURE

BACKGROUND OF THE INVENTION

1. Field of the Invention

This invention relates to closure arrangements, and more particularly to a tamper evident plastic overcap adapted to fit over a neck flange of a drum type container in such a way that the overcap has to be damaged in order to remove it from the container neck flange.

2. Description of the Background Art

A background art search directed to the subject matter of this application and conducted in the United States Patent and Trademark Office disclosed the following United States Letters Patent: U.S. Pat. Nos. 794,880, 1,482,823, 1,887,449, 1,891,003, 1,901,196, 1,982,144, 1,997,203, 2,137,999, 4,095,713, 4,165,018.

None of the patents found in the background search discloses a tamper evident closure arrangement that includes a plastic overcap, adapted to be placed over an enlarged outboard portion of a container neck flange holding a closure plug, and having at an inboard end thereof a plurality of circumferentially spaced projections extending radially inward adjacent the neck flange enlarged portion, so that the overcap cannot thereafter be pulled off of the container neck flange, to afford access to the closure plug, without causing readily noticeable damage to the overcap.

SUMMARY OF THE INVENTION

It is an object of the invention to provide a closure arrangement utilizing a plastic overcap adapted to fit over a drum type container neck flange in such a way that the overcap will be damaged when the overcap is removed from the container.

A more specific object of the arrangement is the provision of a tamper evident overcap, adapted to be placed over an enlarged outboard portion of a container neck flange holding a closure plug, and having at an inboard end thereof a plurality of circumferentially spaced projections extending radially inward adjacent the neck flange enlarged portion, so that the overcap cannot thereafter be pulled off of the container neck flange, to afford access to the closure plug, without causing readily noticeable damage to the overcap.

These and other objects of the invention will be apparent from an examination of the following description and drawings.

DESCRIPTION OF THE PREFERRED EMBODIMENT

Figure 5:
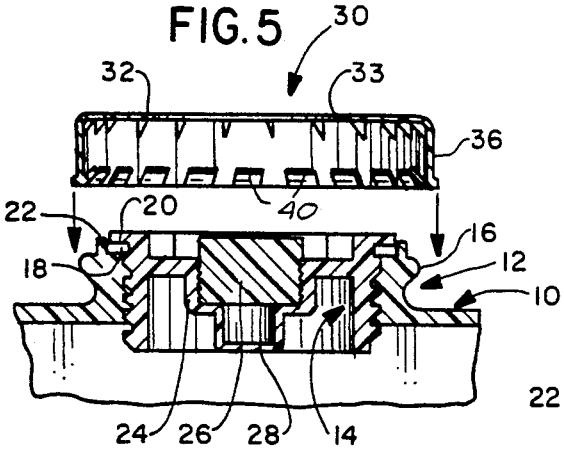
FIG. 5 is an exploded transverse, vertical sectional view of a portion of a container neck flange and a tamper evident overcap, as seen prior to the attachment of the overcap.
Figure 6:
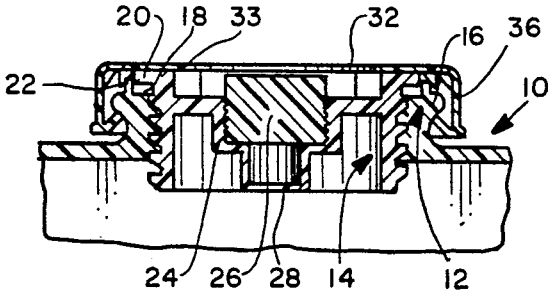
FIG. 6 is a view similiar to that of FIG. 5, but showing the overcap attached to the container neck flange.
Figure 7:
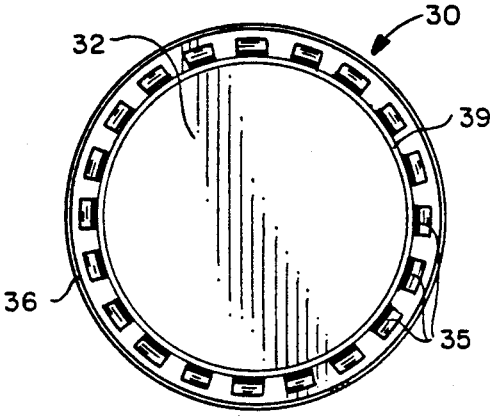
FIG. 7 is a view similiar to that of FIG. 2, but illustrating a modified form of the invention.

Referring now to the drawings for a better understanding of the invention, and particularly to FIGS. 5 and 6, it will be seen that a novel, tamper evident, molded plastic overcap, indicated generally at 30, is shown with a drum type container, indicated generally at 10.

The container 10 includes at least one filling, dispensing, or vent opening from which extends a neck flange 12 adapted to threadably receive a conventional closure plug 14. At its free upper, or outboard, end neck flange 12 presents a circumferentially extending enlarged portion or ridge 16 having a diameter greater than the remaining portion of the neck flange. The purpose of this is described later in the specification.

Still referring to FIGS. 5 and 6, it will be seen that a sealing gasket 18 is interposed between the closure plug 14 and the end of the neck flange. The gasket is maintained in position and prevented from spreading out laterally when the closure plug is screwed tightly on the neck flange by a rim or lip 20 projecting radially outward from the closure plug and a ring or wall 22 projecting axially outboardly from the the neck flange.

If desired the closure plug 14 may be provided with a reducer 24 adapted to receive a second or inner closure plug 26 of substantially smaller diameter than that of closure plug 14. At the bottom of the reducer there may provided a ruptureable membrane 28. The reducer and second closure plug provide an alternate means of access to the contents of the container.

The essential feature of the present invention resides in the unique tamper evident overcap 30 illustrated in FIGS. 1–4 of the drawings. The overcap 30 is preferrably formed of molded plastic material and includes a circular end wall 32 having, extending inboardly from the periphery thereof, an integral, cylindrical side wall or skirt 36.

The end wall 32 may be provided with a central opening 33 extending therethrough, the purpose of which is to afford access to the socket of large plug 14, so that it can be tightened, and also to afford access to the small inner plug 26. Although the inner plug 26 can be reached through the opening 33 in the overcap end wall without damaging the overcap, in order to get any contents out of the container through the reducer 24, it would be necessary to rupture the membrane 28 of the reducer.

As best seen in FIGS. 1–4, the overcap end wall 32 may be provided with a plurality of circumferentially spaced openings 35 extending therethrough which are located radially inward of the outer periphery of the end wall. The purpose of these openings is to facilitate the manufacturing of the overcap by a particular molding process.

Figure 1:
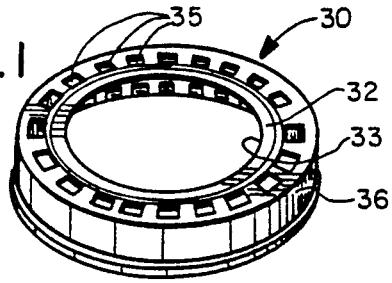
FIG. 1 is a fragmentary isometric view of a tamper evident overcap embodying features of the present invention.
Figure 2:
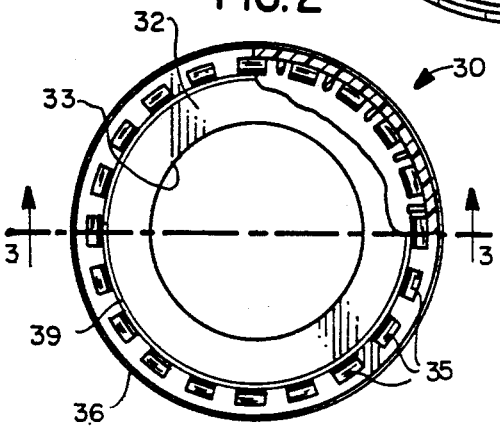
FIG. 2 is a top plan view of the structure illustrated in FIG. 1.
Figure 3:
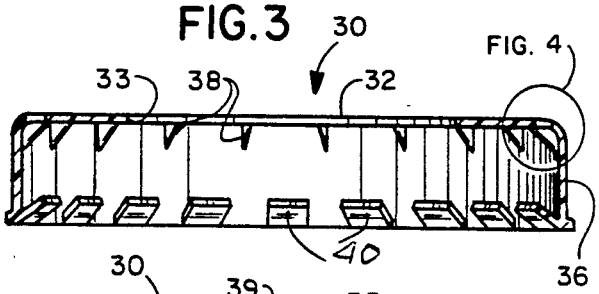
FIG. 3 is a transverse, vertical sectional view taken on line 3—3 of FIG. 2.
Figure 4:
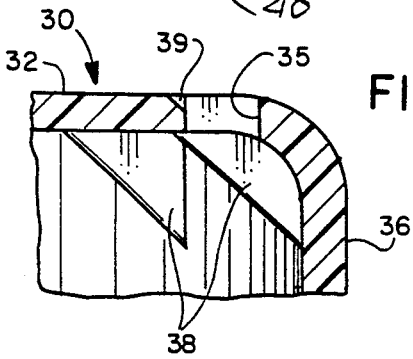
FIG. 4 is an enlarged view of a portion of the structure illustrated in FIG. 3.

As best seen in FIGS. 3 and 4, in order to reinforce the structure of the overcap, there may be provided a plurality of circumferentially spaced reinforcing ribs 38, that extend between adjacent portions of the end wall 32 and the skirt 36 at the corners of the overcap and are located between respective openings 35 of the overcap end wall.

Also, the end wall 32 may also be provided with a line of weakness in the form of an annular groove 39 in the outer surface of the end wall adjacent the outer periphery of the end wall. The purpose of the groove is to facilitate removal of the overcap to afford access to the contents of the container through the neck flange.

The primary novel feature of the overcap 30 resides in the manner in which the overcap is attached to the container neck flange, so that it can't be removed without there being some evidence of its destruction.

Extending radially inward from the skirt 36, at a location inboardly of the container neck flange enlarged portion, are a plurality of projections or fingers 40 adapted to extend under or inboardly of the neck flange enlarged portion 16. The fingers 40 are flexible enough to allow the overcap to be forcibly pushed over the neck flange, but they are rigid enough to prevent the overcap from being pulled off the neck flange without the overcap sustaining visable damage sufficient to indicate opening or the attempt to open the container.

What is claimed is:

1. A tamper evident, closure arrangement for a drum type container having a filling/dispensing opening from which extends a neck flange having a radially outwardly protruding annular ridge and which is adapted to threadably receive an internal closure plug, said arrangement including a tamper evident, unitary, plastic overcap adapted to be threadably received over said container neck flange beyond said annular ridge, said overcap comprising:

(a) a relatively thin, flat, circular, end wall having a round, center section, defined by an annular area of weakness located radially inward of the periphery of said end wall, which center section is readily detachable to provide a round central opening arranged and disposed to afford limited access to said container neck flange closure plug;

(b) a generally cylindrical skirt extending from an outer periphery of said end wall;

(c) a plurality of circumferentially spaced, radially disposed, reinforcing ribs extending between the portion of said end wall located radially outward of said area of weakness and said skirt;

(d) a plurality of circumferentially spaced, integral projections extending radially inward from said skirt and adapted to underlie said container neck flange ridge, so that said overcap cannot be removed from said container neck flange without at least partial destruction of said overcap;

(e) said skirt projections being flexible enough to allow said overcap to be forcibly pushed over an enlarged portion of said container neck flange, and rigid enough to prevent removal of said overcap from said enlarged container neck flange portion without damage to said overcap.

2. A tamper evident, closure arrangement for a drum type container having a filling/dispensing opening from which extends a neck flange having a radially outwardly protruding annular ridge and which is adapted to threadably receive an internal closure plug, said arrangement including a tamper evident, unitary, plastic overcap adapted to be threadably received over said container neck flange beyond said annular ridge, said overcap comprising:

(a) a relatively thin, flat, circular, end wall having a round, central opening arranged and disposed to afford limited access to said container neck flange closure plug and an annular area of weakness located between the periphery of said end wall and the central opening;

(b) a generally cylindrical skirt extending from an outer periphery of said end wall;

(c) a plurality of circumferentially spaced, radially disposed, reinforcing ribs extending between the portion of said end wall located radially outward of said area of weakness and said skirt;

(d) a plurality of circumferentially spaced, integral projections extending radially inward from said skirt and adapted to underlie said container neck flange ridge, so that said overcap cannot be removed from said container neck flange without at least partial destruction of said overcap;

(e) said skirt projections being flexible enough to allow said overcap to be forcibly pushed over an enlarged portion of said container neck flange, and rigid enough to prevent removal of said overcap from said enlarged container neck flange portion without damage to said overcap.

* * * * *